United States Patent [19]

Smith et al.

[11] Patent Number: 5,063,624

[45] Date of Patent: Nov. 12, 1991

[54] MANUAL/ELECTRIC TWIN JACK BED

[75] Inventors: Frank E. Smith, Battle Creek; Stephen C. Travis, Paw Paw Township, Van Buren County, both of Mich.

[73] Assignee: Stryker Corporation, Kalamazoo, Mich.

[21] Appl. No.: 521,144

[22] Filed: May 8, 1990

[51] Int. Cl.[5] ..... A61G 1/00

[52] U.S. Cl. ..... 5/63; 5/86

[58] Field of Search ..... 5/62, 63, 64, 86; 296/20; 269/323

[56] References Cited

U.S. PATENT DOCUMENTS

| | | | |
|---|---|---|---|
| 2,687,536 | 8/1954 | Miller | 5/62 |
| 3,393,004 | 7/1968 | Williams | 5/62 X |
| 3,724,003 | 4/1973 | Ellwanger et al. | 5/63 X |
| 3,814,414 | 6/1974 | Chapa | 269/323 |
| 3,902,204 | 9/1975 | Lee | 5/64 X |
| 3,993,051 | 11/1976 | Maruyama | 5/62 X |
| 4,078,269 | 3/1978 | Weipert | 5/63 |
| 4,912,787 | 4/1990 | Bradcovich | 296/20 X |

*Primary Examiner*—Michael F. Trettel

*Attorney, Agent, or Firm*—Flynn, Thiel, Boutell & Tanis

[57] ABSTRACT

A mobile hospital stretcher includes a movably supported base, and two spaced hydraulic cylinders on the base which vertically movably support a support member having an upwardly facing support surface. Separate control systems are provided for the hydraulic cylinders, one of which is electrically powered and the other of which is mechanically powered. The electrically powered system includes an electrically actuable valve for selectively bleeding fluid from one of the cylinders, an electrically actuable pump for supplying fluid to the other cylinder, a limit arrangement which produces a signal when the first cylinder is fully retracted, a manually operable switch for electrically actuating the valve, and an arrangement responsive to the presence of the first signal during actuation of the switch for electrically actuating the pump.

14 Claims, 2 Drawing Sheets

MANUAL/ELECTRIC TWIN JACK BED

FIELD OF THE INVENTION

This invention relates to a hospital stretcher having a hydraulic arrangement for raising and lowering a patient and, more particularly, to such a stretcher in which the hydraulic arrangement can be both electrically and mechanically operated.

BACKGROUND OF THE INVENTION

It is well known for a hospital stretcher to have a hydraulic arrangement which can raise and lower the mattress on which a patient is supported. Typically, the hydraulic arrangement includes two fluid actuated cylinders provided at spaced locations on the base of the stretcher and each having an upwardly extending piston rod which is pivotally coupled at its upper end to a support frame for the mattress of the stretcher. Traditionally, the hydraulic arrangement is mechanically operated, for example by foot pedals. For example, a first foot pedal may be repeatedly pressed to pump fluid into both of the cylinders in order to raise the mattress, a second foot pedal can be pressed to bleed fluid from one of the cylinders, and a third foot pedal can be pressed to bleed fluid from the other of the cylinders. These known mechanical arrangements can be tiring to operate. Further, hospital personnel sometimes try to operate two or more of the pedals at once for efficiency, for example the pedal which operates the pump and one of the pedals controlling a bleed valve. This is not only awkward, but presents a degree of danger in view of the fact that the person is trying to use each foot to operate a respective pedal and thus may lose his or her balance.

Because of these disadvantages of known mechanical arrangements, interest has developed in electrical controls. One existing stretcher has a scissors mechanism rather than a hydraulic arrangement to permit vertical adjustment of the mattress and patient, and the scissors mechanism is electrically operated by a microprocessor-based circuit controlled by manually operable switches. However, a disadvantage of this system is that the circuitry requires electricity to operate, and there is not always a handy wall outlet into which the power cord for the stretcher can be plugged.

An object of the present invention is therefore to provide a stretcher having a hydraulic arrangement for adjusting the vertical position of a patient and having both electrically powered and mechanically powered systems for controlling the hydraulic arrangement.

A further object of the invention is to provide such a stretcher in which, when an adjustment in the inclination of the patient support surface is needed, appropriate control of both fluid actuated cylinders will be automatically effected.

SUMMARY OF THE INVENTION

The objects and purposes of the invention, including those set forth above, are met according to a first form of the present invention by providing a device which includes a movably supported base, a support member having an upwardly facing support surface, and a fluid actuated support arrangement vertically movably supporting the support member on the base, the support arrangement including a manually powered arrangement and an electrically powered arrangement which can each control the fluid actuated support arrangement.

Another form of the invention involves the provision of a movably supported base, a support member having an upwardly facing support surface, spaced first and second fluid actuated cylinders which movably support the support member on the base, an electrically actuable valve for selectively allowing fluid to escape from the first cylinder, an electrically actuable pump for selectively supplying fluid to the second cylinder, a limit arrangement for producing a signal when the piston rod of the first cylinder is retracted, a manually operable switch for electrically actuating the electrically actuable valve, and an arrangement responsive to the presence of the signal during actuation of the switch for electrically actuating the electrically actuable pump.

BRIEF DESCRIPTION OF THE DRAWINGS

A preferred embodiment of the present invention will be described in detail with reference to the accompanying drawings, in which.

DETAILED DESCRIPTION

Figure 1:
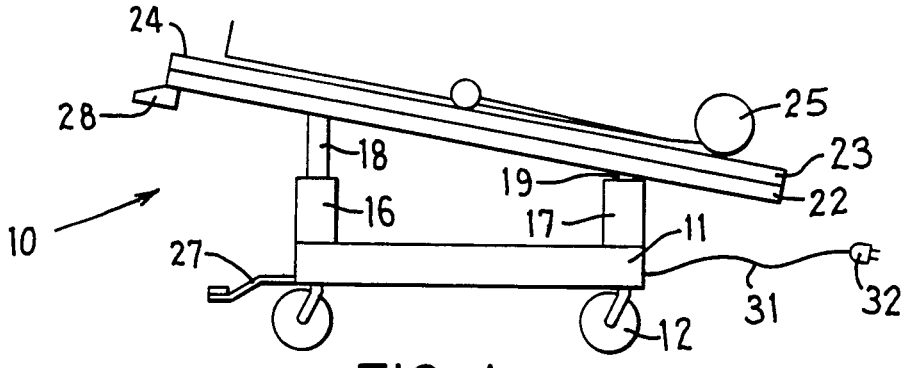
FIG. 1 is a diagrammatic side view of a stretcher embodying the present invention and having a patient supported thereon.

A mobile hospital stretcher which embodies the present invention is shown at 10 in FIG. 1. The stretcher 10 includes a base 11 which is movably supported by four casters having wheels 12, and has supported on top of the base 11 two upright hydraulic jacks or cylinders 16 and 17 which have respective upwardly extending piston rods 18 and 19. The stretcher 10 includes a support frame 22 which is supported by and pivotally coupled to the upper end of each of the piston rods 18 and 19. The support frame 22 supports a mattress 23, which has an upwardly facing support surface 24 for a patient 25. The base 11 of the stretcher 10 has three foot pedals, one of which is shown at 27, and the three foot pedals are used to manually control the hydraulic cylinders 16 and 17 in a manner discussed in more detail later. The stretcher 10 also has an electric control panel 28 mounted at one end of the frame 22, the control panel 28 being used to electrically control the hydraulic cylinders 16 and 17 in a manner described in more detail later. Power for the circuitry associated with electric control panel 28 is obtained from a standard 110 volt wall outlet through a standard line cord 31 and plug 32. It will be recognized that the bed could also have a similar control panel at the opposite end, but to avoid redundancy here only a single such panel is shown and described.

Figure 2:
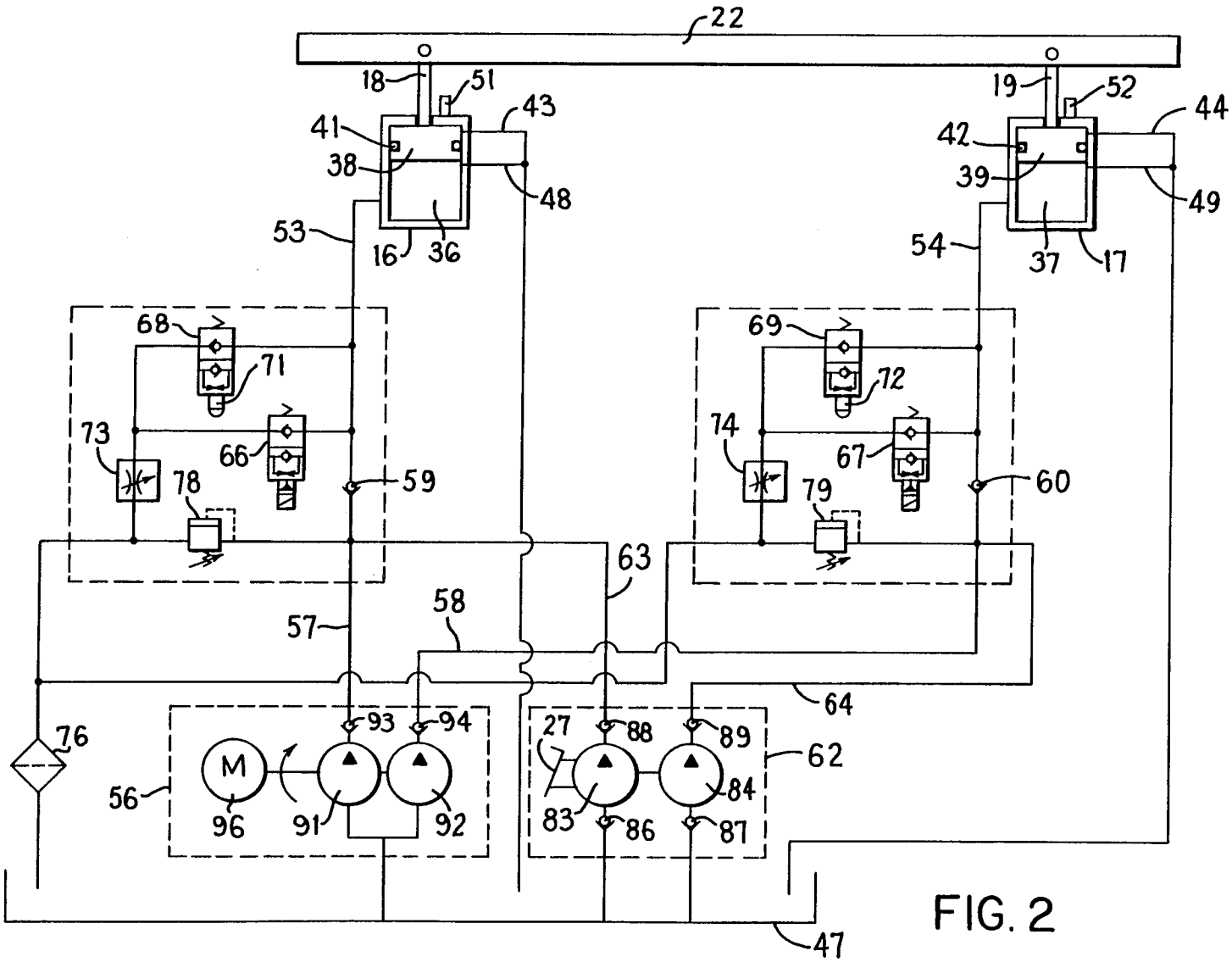
FIG. 2 is a schematic diagram of a hydraulic circuit which is part of the stretcher of FIG. 1.

The hydraulic circuit which controls the hydraulic cylinders 16 and 17 is shown in detail in FIG. 2. The housings of the hydraulic cylinders 16 and 17 enclose respective upright cylindrical chambers 36 and 37 which each have a respective piston 38 or 39 vertically movable disposed therein. The piston rods 18 and 19 are respectively secured to and extend upwardly from the pistons 38 and 39. Each of the pistons 38 and 39 has extending around it a respective annular seal 41 or 42, which slidably sealingly engages the side walls of the associated chamber 36 or 37.

A drain conduit 43 provides fluid communication between the upper end of the chamber 36 in hydraulic cylinder 16 and a fluid reservoir 47. To the extent that any hydraulic fluid leaks from the lower portion of chamber 36 up past the annular seal 41, it can flow out through the drain conduit 43 to reservoir 47 as the piston 38 moves upwardly. A similar drain conduit 44 is provided between chamber 37 of hydraulic cylinder 17 and the reservoir 47.

A bypass conduit 48 communicates with chamber 36 of hydraulic cylinder 16 at a vertical location which is just below the underside of piston 38 when piston 38 is in its uppermost position, as shown in FIG. 2. The bypass conduit 48 communicates, through drain conduit 43, with the reservoir 47. When the piston 38 is below its uppermost position, the bypass conduit 48 is blocked by the piston so that no fluid from the lower portion of chamber 38 can flow into bypass conduit 48, whereas when the piston 38 is in its uppermost position the bypass conduit 48 communicates with the lower portion of chamber 36 so that fluid from chamber 36 can flow through bypass conduit 48 and conduit 43 to the reservoir 47. An equivalent bypass conduit 49 is provided for the hydraulic cylinder 17.

A limit switch 51 is mounted on top of the housing of hydraulic cylinder 16, and is mechanically actuated by the bed frame 22 when the piston 38 of hydraulic cylinder 16 has dropped to its lowermost position. A similar limit switch 52 is provided on top of hydraulic cylinder 17, and is mechanically actuated by the bed frame 22 when the piston 39 of hydraulic cylinder 17 has dropped to its lowermost position. The limit switches 51 and 52 are connected to a circuit which will be described in more detail later in association with FIG. 3.

A control conduit 53 communicates with the chamber 36 of hydraulic cylinder 16 near the lower end of chamber 36. As described below, fluid is supplied to the chamber 36 through conduit 53 in order to cause the piston 38 to move upwardly, and fluid is drained from the chamber 36 through conduit 53 in order to permit the weight of bed frame 22 to move piston 38 downwardly. An equivalent control conduit 54 is provided for the chamber 37 of hydraulic cylinder 17.

An electrically actuated pump mechanism 56 takes fluid from the reservoir 47, and supplies it through respective outlets 57 and 58 to the inlets of respective check valves 59 and 60 which have their outlets respectively coupled to the control conduits 53 and 54. A manually operated pump mechanism 62 takes fluid from the reservoir 47 and supplies it through respective outlets 63 and 64 to the inlets of check valves 59 and 60. Check valves 59 and 60 permit fluid to flow from the pump mechanisms 56 and 62 through control conduits 53 and 54 to chambers 36 and 37, but prevent fluid flow from conduits 53 and 54 back to the pump mechanisms 56 and 62.

Two normally closed, electrically actuated solenoid valves 66 and 67 have inlets which are respectively connected to the control conduits 53 and 54. The valves 66 and 67 are electrically controlled by the circuit of FIG. 3 in a manner described in more detail later. Two normally closed, manually operated valves 68 and 69 have inlets which are also respectively coupled to the control conduits 53 and 54. As mentioned above in association with FIG. 1, the base 11 of stretcher 10 has three foot pedals, only one of which is shown at 27 in FIG. 1. The other two foot pedals are shown diagrammatically at 71 and 72 in FIG. 2, and each opens a respective one of the valves 68 and 69 when manually operated. The four valves 66–69 are each a conventional and commercially available part, and their internal structure is therefore not described in detail here.

The outlets of the two valves 66 and 68 are connected to each other and to an inlet of a manually adjustable throttle valve 73, and in a similar manner the outlets of the valves 67 and 69 are connected to each other and to the inlet of a manually adjustable throttle valve 74. The outlets of the throttle valves 73 and 74 are connected to each other and to the inlet of a conventional and commercially available filter unit 76, the outlet of the filter unit 76 communicating with the reservoir 47.

A manually adjustable pressure regulating valve 78 has its inlet connected to the outlets 57 and 63 of pump mechanisms 56 and 62, and has its outlet connected to the inlet of filter 76. A similar pressure regulating valve 79 has its inlet connected to the outlets 58 and 64 of pump mechanisms 56 and 62, and has its outlet connected to the inlet of filter 76. If the outlet pressure produced by either of the pump mechanisms 56 and 62 exceeds a manually preset pressure value at either of valves 78 and 79, that valve will bleed fluid from the pump outlet to the filter 76 so that the fluid pressure ultimately supplied through check valve 59 or check valve 60 does not exceed the preset pressure value of the associated regulating valve 78 or 79. The regulating valves 78 and 79 are conventional and commercially available parts, and their internal structure is therefore not described here in detail.

The manually operated pump mechanism 62 includes two mechanically operated pumps 83 and 84 which are conventionally and commercially available parts, the pumps 83 and 84 drawing fluid from reservoir 47 through respective check valves 86 and 87, and supplying fluid through respective pump check valves 88 and 89 to the respective outlets 63 and 64 of pump mechanism 62. The pumps 83 and 84 are both coupled to and simultaneously operated by the foot pedal shown at 27 in FIGS. 1 and 2.

Figure 3:
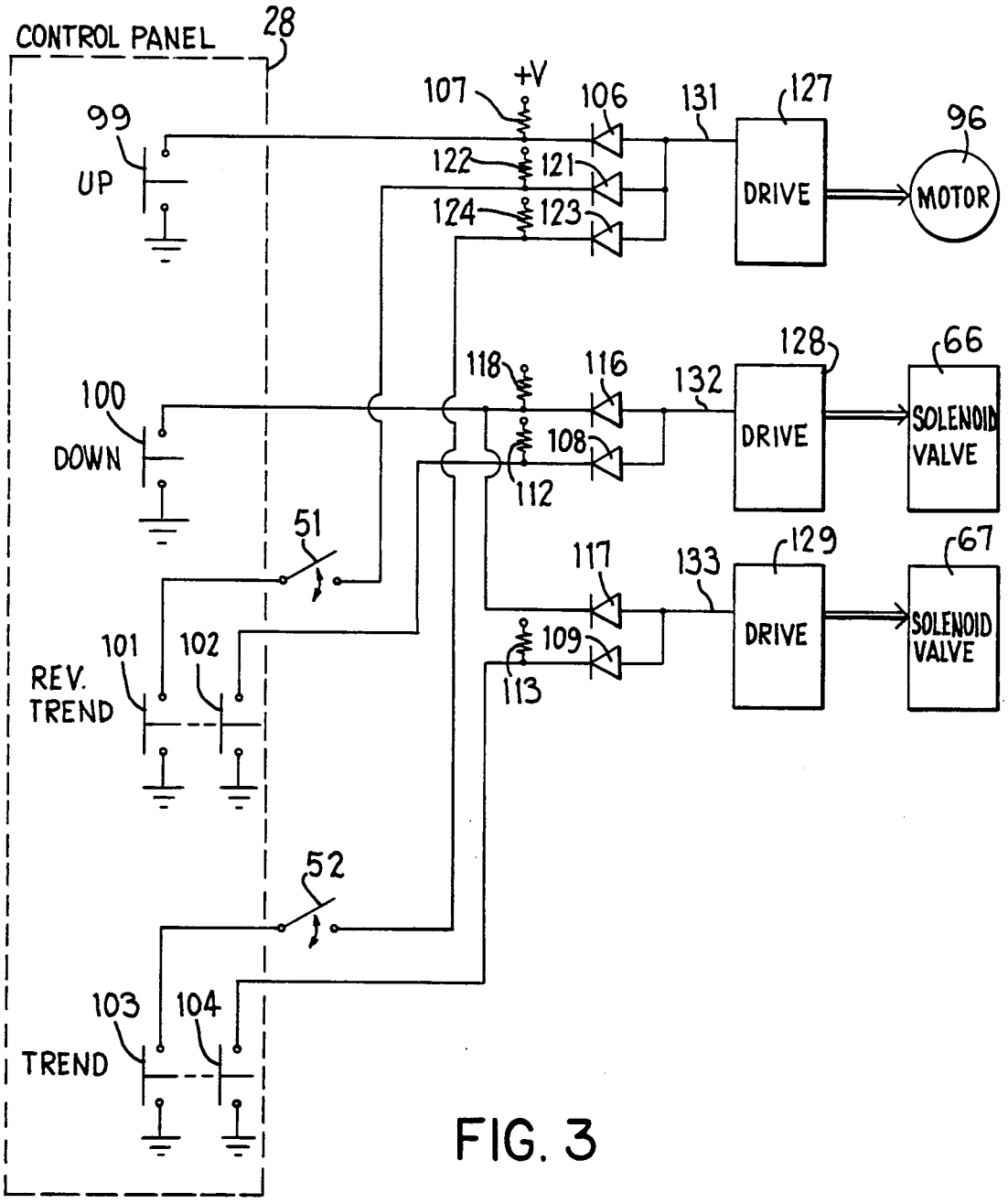
FIG. 3 is a schematic diagram of an electric circuit which is part of the stretcher of FIG. 1.

The electrically actuated pump mechanism 56 includes two conventional and commercially available pump units 91 and 92, which each draw fluid from the reservoir 47 and supply it through respective pump check valves 93 and 94 to the respective outlets 57 and 58 of pump mechanism 56. In the preferred embodiment, the pumps 91 and 92 are parts obtained commercially from Mechanical Tool and Engineering Co., in particular Model No. S201013381. The pumps 91 and 92 have rotatable drive shafts which are coupled together and driven simultaneously by a common electric motor 96, the motor 96 being selectively electrically actuated by the electrical circuit which is shown in FIG. 3 and described below. When the electrical pump mechanism 56 is deactuated and the manual pump mechanism 62 is being operated, the pump check valve 93 prevents fluid supplied to outlet 63 by pump 83 from flowing through pump 91 to the reservoir 47, and the pump check valve 94 prevents fluid supplied to outlet 64 by pump 84 from flowing through pump 92 to the reservoir 47. Similarly, when the electrical pump mechanism 56 is actuated and the manual pump mechanism 62 is not being operated, the pump check valve 88 prevents fluid supplied to outlet 57 by pump 91 from flowing through pump 83 to reservoir 47, and the pump check valve 89 prevents fluid supplied to outlet 58 by pump 92 from flowing through pump 84 to reservoir 47.

Turning to FIG. 3, the electrical control panel 28 includes four momentary push button switch units which are respectively labeled UP, DOWN, REV TREND and TREND. TREND refers to the trendelenburg position, in which a patient is inclined so that his head is lower than his feet (as in FIG. 1), whereas REV TREND refers to the reverse trendelenburg position in which the patient is inclined so that his feet are lower than his head. The UP switch unit includes a single switch 99, the DOWN switch unit includes a single switch 100, the REV TREND switch unit is a conventional double pole single throw device having two separate switches 101 and 102 which operate simultaneously, and the TREND switch unit is also a conventional double pole single throw device having two switches 103 and 104 which also operate simultaneously.

Switch 99 has one terminal connected to ground and the other terminal connected to the cathode of a diode 106 and one end of a pull-up resistor 107. The switches 102 and 104 each have one terminal connected to ground and the other terminal connected to the cathode of a respective diode 108 and 109 and one end of a respective pull-up resistor 112 or 113. The switch 100 has one terminal connected to ground and the other terminal connected to the cathodes of two diodes 116 and 117 and one end of a pull-up resistor 118. The switch 101 has one terminal connected to ground and the other terminal connected to one end of limit switch 51, the other end of limit switch 51 being connected to the cathode of a diode 121 and one end of a pull-up resistor 122. The switch 103 has one terminal connected to ground and the other terminal connected to one end of limit switch 52, the other end of limit switch 52 being connected to the cathode of a diode 123 and one end of a pull-up resistor 124. The pull-up resistor 107 has its upper end in FIG. 3 connected to a source of a constant positive d.c. voltage V, and the same is true of the other five pull-up resistors 112, 113, 118, 122 and 124 in FIG. 3.

The anodes of diodes of 106, 121 and 123 are connected at 131 to each other and to a control input of a drive circuit 127 which can selectively energize the motor 96 of the pump mechanism 56 of FIG. 2 in dependence on the state of its control input. The anodes of diodes 116 and 108 are connected at 132 to each other and to a control input of a drive circuit 128, and the anodes of diodes 117 and 109 are connected at 133 to each other and to the control input of a drive circuit 129, the drive circuits 128 and 129 respectively selectively energizing the solenoid valves 66 and 67 for the hydraulic circuit of FIG. 2 in dependence on the state of the control signals at their control inputs. Those of ordinary skill in the art are familiar with the type of circuitry commonly used for the drive circuits 127–129, and the drive circuits 127–129 are therefore are not shown in detail. Each might, for example, include a conventional relay, the coil of which is controlled by the signal present at the control input of the drive circuit, and the contact of which couples a conventional source of electrical power to the output of the drive circuit when the contact is closed.

OPERATION

Referring to FIG. 2, the manner in which the hydraulic system can be manually controlled will be explained first. It is assumed that the pistons 38 and 39 are each initially in their lowermost positions within the hydraulic cylinders 16 and 17. If the foot pedal 27 is repeatedly pressed, the pumps 83 and 84 will each draw fluid from the reservoir 47 and eject it into a respective outlet 63 or 64, so that hydraulic fluid flows through each of the check valves 59 and 60 and into the lower portion of chambers 36 and 37, causing pistons 38 and 39 to simultaneously move upwardly, which in turn causes the support frame 22 to move upwardly while remaining horizontal. When the operator stops pushing the pedal 27, the pistons 38 and 39 will each stop at their current vertical level. If the operator continues to press the pedal 27 until the pistons 38 and 39 each reach their uppermost position, the openings to bypass conduits 48 and 49 will be exposed and thus any additional fluid flowing into the chambers 36 and 37 will flow out through the bypass conduits 48 and 49 to the reservoir 47, so that there is no excess pressure built up in the hydraulic cylinders 16 and 17.

The foot pedals 71 and 72 for the normally closed manual valves 68 and 69 are preferably located adjacent each other so that an operator can step on them simultaneously. When an operator does step on them simultaneously, the valves 68 and 69 will simultaneously open, and fluid will flow from chamber 36 through conduit 53, valve 68, throttle 73 and filter 76 to the reservoir 47, while fluid also flows from the chambers 37 through conduit 54, valve 69, throttle 74 and filter 76 to reservoir 47. The throttles 73 and 74 are preferably adjusted so that the fluid flow rates through them are substantially identical, as a result of which the pistons 38 and 39 will drop at substantially the same rate so that the frame 22 will move vertically downwardly without any change in inclination.

If the operator wishes to incline the frame 22 in the manner shown in FIG. 1 so that the patient's head is lower than his feet, the operator manually presses only the foot pedal 72 in FIG. 2, so that valve 69 is opened and fluid escapes only from the chamber 37 and only the piston 39 drops downwardly, the position of the piston 38 remaining unchanged. Alternatively, if the operator wished to achieve an inclination opposite that shown in FIG. 1, namely where the patient's feet are lower than his head, the operator would manually press only the foot pedal 71 in FIG. 2, so that valve 68 would permit the escape of fluid only from chamber 36 in order to cause only the piston 38 to move downwardly, the piston 39 remaining in its current position without any change.

If the frame 22 is already inclined and then the foot pedals 71 and 72 are pressed simultaneously, fluid will escape through valves 68 and 69 from both of the chambers 36 and 37, so that the pistons 38 and 39 both move downwardly and the bed frame 22 moves downwardly without any change in its angle of inclination. Of course, one of the pistons which is lower than the other will eventually reach its lowermost position and stop moving downwardly, after which the other will continue downwardly if the operator continues to press the associated foot pedal, the result of which will be that the frame 22 will gradually return to a horizontal orientation.

At the hydraulic level, the electrically actuated pump mechanism 56 and the electrically actuated valves 66 and 67 correspond directly in function to the manually operated pump mechanism 62 and the manually operated valves 68 and 69. In particular, if the motor 96 is actuated, the pumps 91 are 92 are both driven and respectively supply fluid through check valves 59 and 60 so that the pistons 38 and 39 both move upwardly simultaneously. If the valve 66 is electrically actuated, fluid can escape from chamber 36 so that piston 38 moves downwardly, whereas if the valve 69 is electrically actuated fluid can escape from chamber 37 so that the piston 39 moves downwardly. However, the manner in which the electrically actuated valves 66 and 67 and electrically actuated pump mechanism 56 are actuated is a little different from the manner in which the manually operated valves 68 and 69 and pump mechanism 62 are actuated, due to the presence of limit switches 51 and 52 and the circuit shown in FIG. 3.

More specifically, when an operator presses and holds the switch unit labeled UP on control panel 28, the switch 99 is closed and grounds the cathode of diode 106, pulling the control input 131 of drive circuit 127 to a lower voltage, which causes the drive circuit 127 to actuate the motor 96 for pump mechanism 56 of FIG. 2. Accordingly, the pistons 38 and 39 simultaneously move upwardly, and each continues to move upwardly until it reaches its uppermost position or until the switch 99 opens, whichever occurs first.

If the switch unit labeled DOWN is pressed, the switch 100 closes and connects the cathodes of diodes 116 and 117 to ground, thereby pulling down the voltages at the control inputs 132 and 133 of the drive circuits 128 and 129, so that the drive circuits 128 and 129 respectively electrically actuate the solenoid valves 66 and 67 of FIG. 2, thereby opening these valves so that fluid escapes from each of the chambers 36 and 37 in the hydraulic cylinders 16 and 17. The pistons 38 and 39 thus move simultaneously downwardly, and each continues to move downwardly until it reaches its lowermost position or until the switch 100 opens, whichever occurs first.

The switch labeled REV TREND in FIG. 3 is pressed when an operator wishes to incline the frame so that the patient's feet are lower than his head, whereas the switch unit labeled TREND is pressed when the operator wishes to incline the frame so that, as shown in FIG. 1, the patient's head is lower than his feet. When the switch unit REV TREND is pressed, the switches 101 and 102 are simultaneously closed. The switch 102 forces the cathode of diode 108 to ground, thereby causing drive circuit 128 to energize solenoid valve 66 of FIG. 2 so that fluid escapes from the chamber 36 of hydraulic cylinder 16 and the piston 38 drops, the piston 39 of hydraulic cylinder 17 remaining stationary. Thus, the patient's feet begin to move downwardly relative to his head. If the piston 38 reaches its lowermost position and the operator continues to press the REV TREND switch unit so that switches 101 and 102 remain closed, the engagement of frame 22 with limit switch 51 will cause limit switch 51 to close, and switches 101 and 51 will thus ground the cathode of diode 121 and cause the drive circuit 127 to energize motor 96 for the pump mechanism 56 of FIG. 2. Thus, pumps 91 and 92 in FIG. 2 will begin supplying fluid through check valves 59 and 60. The fluid supplied through check valve 60 to chamber 37 will cause the piston 39 to begin moving upwardly. Meanwhile, since the closed switch 102 is still keeping the valve 66 open, fluid supplied by pump 91 through check valve 59 will flow through valve 66, throttle 73 and filter 76 back to the reservoir 47, and will not flow into chamber 36 and will not cause piston 38 to move upwardly. Consequently, inclination of the frame 22 in the desired manner will continue to occur, the patient's feet becoming progressively lower relative to the patient's head. When the REV TREND switch unit is released by the operator, the bed frame 22 stops at and remains in its current angle of inclination.

If the operator actuates the TREND switch unit, a sequence which is basically a mirror image of that just described will occur. In particular, the valve 67 will initially be open so that fluid escapes from chamber 37 and piston 39 moves downwardly, and if piston 39 reaches it lowermost position the limit switch 52 will be actuated and energize the motor 96 so that pump mechanism 56 supplies fluid to chamber 36 and moves piston 38 upwardly, the open valve 67 preventing fluid from pump mechanism 56 from moving piston 39 upwardly.

Although a preferred embodiment of the present invention has been described in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus comprising: a movably supported base, a support member having an upwardly facing support surface, and fluid actuated support means vertically movably supporting said support member on said base, said support means including manually powered means for selectively effecting upward and downward movement of said support member relative to said base and electrically powered means for selectively effecting upward and downward movement of said support member relative to said base, wherein said support means includes a fluid actuated cylinder having a housing coupled to one off said base and said support member and having a piston rod which is movable relative to said housing between extended and retracted positions and which is coupled to the other of said base and support member, said manually powered means including manually powered pump means for supplying fluid from a fluid source to said cylinder and manually operated valve means for selectively allowing fluid to escape from said cylinder, and wherein said electrically powered means includes electrically powered pump means for selectively supplying fluid from said fluid source to said cylinder and electrically actuated valve means for selectively allowing fluid to escape from said cylinder.

2. An apparatus as recited in claim 1, wherein said support means includes a second cylinder spaced from said first-mentioned cylinder and having a housing coupled to one of said base and said support member and having a piston rod which is movable relative to said housing between extended and retracted positions and which is coupled to the other of said base and support member, said manually powered pump means supplying fluid to each of said first-mentioned and second cylinders when manually operated, said electrically powered pump means supplying fluid to each of said first-mentioned and second cylinders when electrically actuated, said electrically powered means including second electrically actuated valve means for selectively allowing fluid to escape from said second cylinder, and said manually powered means including second manually operated valve means for selectively allowing fluid to escape from said second cylinder.

3. An apparatus as recited in claim 2, wherein said electrically powered means includes first limit means for producing a first signal when said piston rod of said first-mentioned cylinder is in its retracted position and second limit means for producing a second signal when said piston rod of said second cylinder is in its retracted position, includes means responsive to the presence of said first signal when said first-mentioned electrically actuated valve means is electrically actuated for electrically actuating said electrically powered pump means, and includes means responsive to the presence of said second signal when said second electrically actuated valve means is actuated for electrically actuating said electrically powered pump means.

4. An apparatus as recited in claim 3, wherein said manually powered means includes a first manually operable foot pedal movably supported on said base and drivingly coupled to said manually powered pump means, a second manually operable foot pedal movably supported on said base and drivingly coupled to said first-mentioned manually operable valve means, and a third manually operable foot pedal movably supported on said base and drivingly coupled to said second manually operable valve means; and wherein said electrically powered means includes a first switch and means for electrically actuating said electrically powered pump means in response to manual operation of said first switch, a manually operable second switch and means responsive to manual operation of said second switch for simultaneously actuating said first-mentioned and second electrically actuable valve means, a manually operable third switch and means responsive to manual operation of said third switch for electrically actuating said first-mentioned electrically actuable valve means, and a manually operable fourth switch and means responsive to manual operation of said fourth switch for electrically actuating said second electrically actuable valve means, said means responsive to said first signal being respectively enabled and disabled when said third switch is respectively actuated and deactuated, and said means responsive to said second signal being respectively enabled and disabled when said four switch is respectively actuated and deactuated.

5. An apparatus as recited in claim 2, wherein said electrically powered pump means supplies fluid through first and second check valves to respective first and second control conduits which each communicate with one end of a fluid chamber in a respective one of said first-mentioned and second cylinders, said manually powered pump means supplying fluid through each of said first and second check valves to said first and second control conduits, said first-mentioned electrically actuated valve means and said first-mentioned manually operated valve means each having an inlet coupled to said first control conduit, and said second electrically actuated valve means and said second manually operated valve means each having an inlet coupled to said second control conduit.

6. An apparatus as recited in claim 5, wherein said first-mentioned and second cylinders each have a piston supported in said chamber thereof for movement between positions adjacent and spaced from said one end thereof; including a first bypass conduit which communicates with said chamber of said first-mentioned cylinder at a location which, when said piston in said first-mentioned cylinder is in said position spaced from said one end of said chamber therein, is adjacent and on a side of the piston nearest to said one end of said chamber in said first-mentioned cylinder; and including a second bypass conduit which communicates with said chamber in said second cylinder at a location which, when said piston in said second cylinder is in said position spaced from said one end of said chamber therein, is adjacent and on a side of the piston nearest to said one end of said chamber in said second cylinder.

7. An apparatus as recited in claim 6, including first and second drain conduits which respectively communicate with said chambers in said first-mentioned and second cylinders at an end of each chamber remote from said one end thereof.

8. An apparatus as recited in claim 5, wherein said first-mentioned electrically actuated valve means and said first-mentioned manually operated valve means have respective outlets which are connected to each other and to an inlet of an adjustable first throttle valve, said first throttle valve having an outlet which is coupled to an inlet of a filter, and said filter having an outlet which is coupled to said fluid source, and wherein said second electrically actuated valve means and said second manually operated valve means have respective outlets which are connected to each other and to an inlet of an adjustable second throttle valve, said second throttle valve having an outlet which is coupled to said inlet of said filter.

9. An apparatus as recited in claim 8, including a first adjustable pressure regulating valve having an inlet coupled to the inlet of said first check valve and an outlet coupled to the outlet of said first throttle valve, and including a second adjustable pressure regulating valve having an inlet coupled to the inlet of said second check valve and an outlet coupled to the outlet of said second throttle valve.

10. An apparatus as recited in claim 5, wherein said electrically actuated powered pump means includes first and second pumps which are driven simultaneously by a common electrically actuated motor and which each supply fluid from said fluid source through a respective pump check valve to the inlets of said first and second check valves, respectively; and wherein said manually powered pump means includes third and fourth pumps which are synchronously operated by a single manually operated foot pedal and which each supply fluid from said fluid source through a respective pump check valve to the inlet of said first and second check valves, respectively.

11. An apparatus comprising: a movably supported base; a support member having an upwardly facing support surface; spaced first and second fluid actuated cylinders which each have a housing operatively coupled to one of said base and support member and a piston rod coupled to the other of said base and support member, each said piston rod being movable between extended and retracted positions relative to its housing; electrically actuable valve means for selectively allowing fluid to escape from said first cylinder; electrically actuable pump means for selectively supplying fluid to said second cylinder; limit means for producing a first signal when said piston rod of said first cylinder is in its retracted position; manually operable switch means for selectively electrically actuating said electrically actuable valve means; and means responsive to the presence of said signal during actuation of said manually operable switch means for electrically actuating said electrically actuable pump means to supply fluid to said second cylinder.

12. An apparatus as recited in claim 11, wherein said electrically actuable pump means supplies fluid simultaneously to said first and second cylinders; including second electrically actuable valve means for selectively permitting fluid to escape from said second cylinder; including second manually operable switch means for selectively electrically actuating said second electrically actuable valve means; including second limit means for producing a second signal when said piston rod of said second cylinder is in its retracted position; and including means responsive to the presence of said second signal during actuation of said second switch means for electrically actuating said pump means to supply fluid to said first cylinder.

13. An apparatus comprising: a base; a support member having an upwardly facing support surface; spaced fluid actuated first and second cylinders which each have one end supported on said base and a further end supported on said support member and which facilitate vertical movement of said support member relative to said base; and electrically actuated fluid pump means for simultaneously supplying fluid to each of said first and second cylinders so that said further ends of said first and second cylinders move simultaneously upwardly; wherein said pump means includes two pumps which each supply fluid to a respective one of said first and second cylinders and a single electric motor having a drive shaft which is drivingly coupled to each of the pumps.

14. An apparatus comprising: a base; a support member having an upwardly facing support surface; spaced first and second fluid actuated cylinders which each have a housing operatively coupled to one of said base and support member and a piston rod coupled to the other of said base and support member, each said piston rod being movable between extended and retracted positions relative to its housing; selectively actuable valve means for allowing fluid to escape from said first cylinder; electrically actuable pump means for selectively supplying fluid to said second cylinder; limit means for producing a signal when said piston rod of said first cylinder is in its retracted position; manually operable means for selectively actuating said valve means; and means responsive to the presence of said signal during actuation of said manually operable means for electrically actuating said electrically actuable pump means to supply fluid to said second cylinder.

* * * * *

UNITED STATES PATENT AND TRADEMARK OFFICE

CERTIFICATE OF CORRECTION

PATENT NO. : 5 063 624

DATED : November 12, 1991

INVENTOR(S) : Frank E. SMITH et al

It is certified that error appears in the above-identified patent and that said Letters Patent is hereby corrected as shown below:

Column 8, line 34; replace "off" with ---of---.

Column 9, line 39; replace "four" with ---fourth---.

Signed and Sealed this

Sixth Day of April, 1993

*Attest:*

STEPHEN G. KUNIN

*Attesting Officer*

*Acting Commissioner of Patents and Trademarks*